United States Patent [19]

LaBate

[11] Patent Number: 4,709,903

[45] Date of Patent: Dec. 1, 1987

[54] SLAG RETAINING DEVICE FOR USE IN CONVERTERS, LADLES, OR THE LIKE

[76] Inventor: Micheal D. LaBate, 115 Hazen Ave., Ellwood City, Pa. 16117

[21] Appl. No.: 860,826

[22] Filed: May 8, 1986

[51] Int. Cl.[4] ..... C21C 5/46

[52] U.S. Cl. ..... 266/227; 266/45; 266/230; 222/597

[58] Field of Search ..... 266/227, 230, 272, 45; 222/597, 591, 598, 602

[56] References Cited

U.S. PATENT DOCUMENTS

| | | | |
|---|---|---|---|
| 4,494,734 | 1/1985 | LaBate et al. | 266/230 |
| 4,526,349 | 7/1985 | Schwer | 266/45 |
| 4,601,415 | 7/1986 | Koffron | 266/230 |

FOREIGN PATENT DOCUMENTS

| | | | |
|---|---|---|---|
| 0047314 | 3/1984 | Japan | 266/230 |
| 0461293 | 4/1975 | U.S.S.R. | 266/230 |
| 0590340 | 1/1978 | U.S.S.R. | 266/230 |

*Primary Examiner*—L. Dewayne Rutledge
*Assistant Examiner*—S. Kastler
*Attorney, Agent, or Firm*—Harpman & Harpman

[57] ABSTRACT

A device for the separation of slag and its retention in a converter, ladle, or the like, consists of a closure commonly called a dart, adapted to be placed either manually or automatically in the tap hole of the converter or ladle during tapping of molten metal therefrom. The device may have smooth exterior surfaces or may include configurations enabling it to substantially close the tap hole and impart a swirling motion to the molten metal and slag therein. The device may be formed of material having a specific gravity lower than that of the metal in the converter or ladle, but higher than that of the slag thereon or alternately having a specific gravity higher than that of the metal to facilitate manual placement of the device in the tap hole.

8 Claims, 7 Drawing Figures

SLAG RETAINING DEVICE FOR USE IN CONVERTERS, LADLES, OR THE LIKE

BACKGROUND OF THE INVENTION

1. Technical Field

This invention relates to a slag retaining device for use in tapping converters or hot metal ladles during the tapping of steel therefrom. The use of the device permits the tapping of steel free from slag.

2. Description of the Prior Art

Prior devices for blocking or minimizing slag carry over when tapping molten steel from a converter or ladle are known in the art and a typical disclosure of a device requiring manual placement is seen in Canadian Pat. No. 822,607. An example of a prior art floatable device may be seen in U.S. Pat. No. 4,462,574, W. M. Keenan, and U.S. Pat. No. 4,494,734, M. D. LaBate, It is an object of the present invention to overcome the disadvantages of the above-mentioned prior art and to provide an improved automatically placed floatable device for minimizing slag carry over during tapping of molten metal from a converter or ladle and to provide a manually insertable device forming a closure having guide means and movable into the tap hole of the converter or ladle at a desired time to prevent molten slag from flowing therethrough. The device in its preferred form is combined with a cylindrical refractory sleeve positioned in the tap hole of the converter or ladle and forms circular valve seat for engagement with the slag retaining device and avoids the erosion of the material heretofore used in defining the tap hole which frequently resulted in an irregularly shaped tap hole and inability of a slag retaining device to properly seat therein.

SUMMARY OF THE INVENTION

The slag retaining device of the present invention is disclosed herein in two forms. The first of these is a manually insertable stopper body, commonly called a dart, which incorporates a depending guide member engageable in the tap hole and insures the accurate placement of the stopper body in closing relation to the tap hole. Alternate configurations of the stopper body increase the efficiency of the same with respect to its placement in and engagement with the tap hole particularly when the tap hole is defined by a cylindrical refractory member preformed and positioned in the refractory lining of the converter or ladle in registry with the tap hole therein.

A variation of the form of the slag retaining device has a specific gravity lower than that of the steel, but higher than that of the slag therein in the converter or ladle and is automatically partially positioned in the tap hole where its configuration causes the swirling of the metal and the slag which may be visually observed and indicates that the slag is about to reach the tap hole whereupon the tapping of the converter or ladle may be terminated.

DESCRIPTION OF THE PREFERRED EMBODIMENTS

Figure 1:
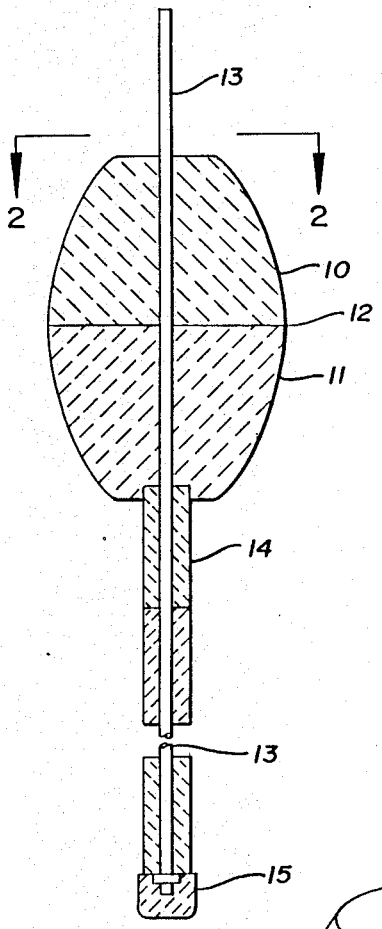
FIG. 1 is a vertical section through the manually insertable form of the slag retaining device.
Figure 2:
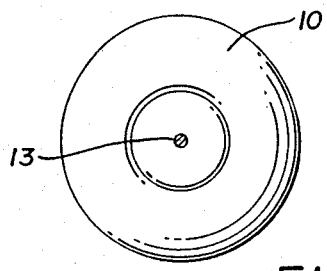
FIG. 2 is a top plan view of the slag retaining device.
Figure 6:
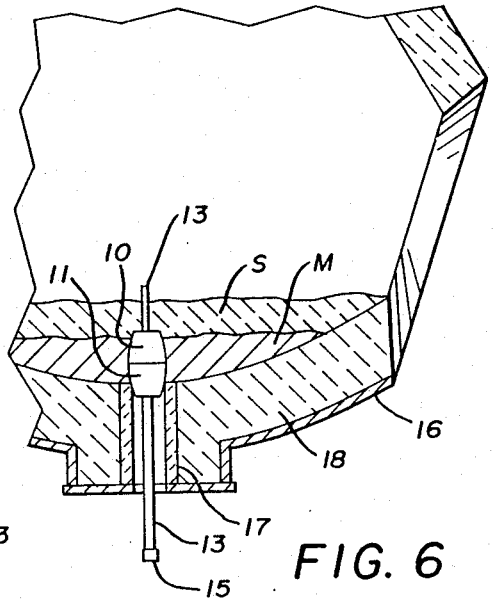
FIG. 6 is a cross sectional view of a portion of a converter showing a cylindrical refractory sleeve defining the tap hole therein with molten steel above the tap hole and molten slag thereon and the slag retaining device of FIG. 1 positioned in the tap hole.

In the form of the invention seen in FIGS. 1, 2 and 6 of the drawings, an upright, oval shaped body, which is cross sectionally circular, is preferably formed of upper and lower modified cone-shaped members 10 and 11 arranged in oppositely disposed relation to one another has its area of largest diameter 12 at its center, said area of largest diameter 12 being substantially greater than that of a tap hole in a converter or ladle in which it is to be placed.

The slag retaining device is shown assembled on a steel rod 13 with a portion of the rod 13 below the lower member 11 enclosed in sleeves 14 of fireproof material such as a suitable refractory and including a cap 15 surrounding a fastener on the lower end of the rod 13. The rod 13 extends vertically through the members 10 and 11 and upwardly and outwardly thereof and provides a portion of the slag retaining device that may be detachably engaged by a mechanical device used to position the slag retaining device in the tap hole.

In FIG. 6 of the drawings, the slag retaining device is shown in the tap hole of a converter 16 in which a pool of molten metal M topped by a layer of molten slag S are illustrated. The tap hole in the converter 16 is defined by a refractory sleeve 17 which extends through the layer of insulating refractory 18 which lines the converter 16.

Those skilled in the art will observe that the slag retaining device with its smooth, modified, global shape is inserted into the converter or ladle before a vortex forms as the final portion of metal starts to drain out of the tap hole. The time may be calculated from the estimated tonage of metal contained in the converter or ladle and the size and the shape of the tap hole in relation to the contents. It is desirable that the slag retaining device be introduced into the converter or ladle within a calculated time of between one to two minutes before the end of the tap when all of the metal is drained from the furnace.

The preferred density of the slag retaining device for use in steel making is preferably between 0.12 to 0.22 lbs. per square inch. The material of the upper and lower members 10 and 11 is preferably substantially indissoluble in the molten metal and the slag and its density is such that it floats at or near the surface of the molten steel M and at the junction of the molten metal and the slag where its contoured modified global shape permits the molten steel to flow around the same and cause a bobbing action before finally seating in the tap hole where it stops the slag from flowing through the tap hole.

It will also be seen that the modified global shape of the slag retaining device when placed in the vortex formed by the molten metal above the tap hole will rotate several times before seating itself firmly. The rotation insures the desirable positioning of the slag retaining device in the tap hole which may be uneven or erroded which would otherwise tend to tilt the slag retaining device and permit an undesired amount of slag to flow out of the tap hole.

In order to form the modified global-shaped body of the slag retaining device comprising the upper and lower body members 10 and 11, a suitable mix may comprise refractory cement 8 lbs., fine iron ore concentrate 16 lbs., steel shot 30 lbs., stainless steel fibers 2 lbs., and water from 3 lbs. to 5 lbs. This formula will produce a body having a density of from 0.15 to 0.17 lbs./inch 3 although any density between that of the slag 0.10 lbs./inch 3 and that of molten steel, about 0.25 lbs./inch 3 is suitable.

Figure 3:
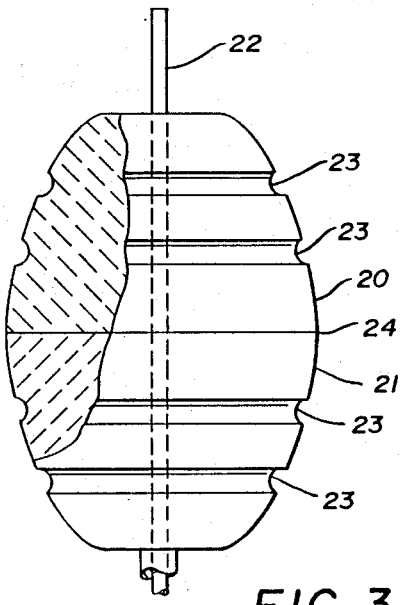
FIG. 3 is a side elevation with parts broken away showing the slag retaining device with annular grooves formed in its exterior surface.
Figure 4:
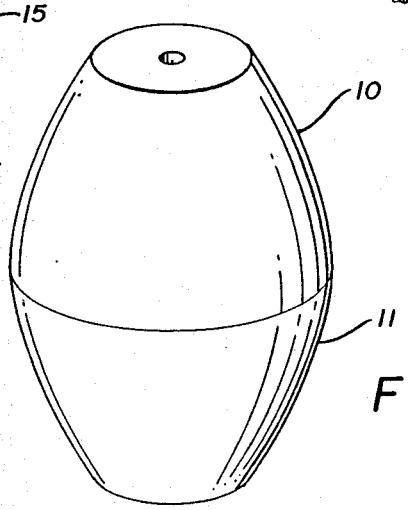
FIG. 4 is a perspective view of an alternate form of the device seen in FIGS. 1 and 2 wherein the guide rod is eliminated.
Figure 5:
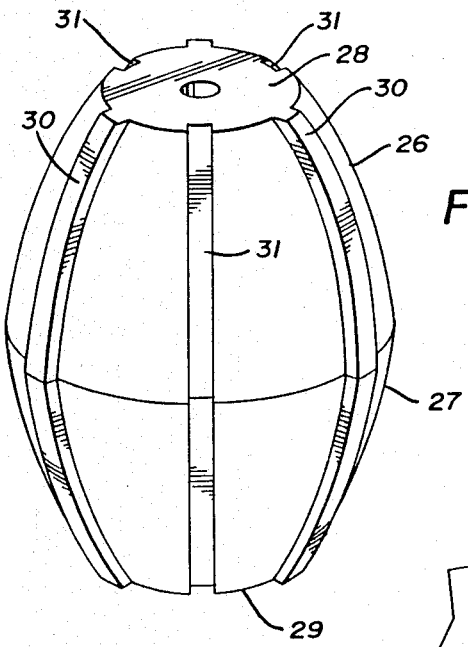
FIG. 5 is a perspective view of a further alternate form of the slag retaining device of FIG. 4.

It will occur to those skilled in the art that the shape of the exterior of the slag retaining device of FIGS. 1, 2, 4 and 6 of the drawings may be changed to increase its efficiency and one such modification is illustrated in FIG. 3 of the drawings wherein the modified, global-shaped body of the slag retaining device is formed of upper and lower members 20 and 21 respectively, assembled on a steel rod 22, the members 20 and 21 provided with several annular grooves 23 spaced with respect to the area of widest diameter 24 of the device. A broken away section of the device is illustrated in FIG. 3 of the drawings and the material of the device may be the same in the upper and lower members 20 and 21 or it may differ as to density so as to desirably control the floating relation of the device with respect to the molten metal and slag as hereinbefore described. The annular grooves 23 assist in the final closing of the tap hole when the same moves in a bobbing action and/or rotates as it nears the same in the vortex of the metal flowing through the tap hole as defined by a refractory sleeve 17 which is illustrated in FIG. 6 of the drawings and hereinbefore described. A further modification of the invention may be seen in FIGS. 5 and 7 of the drawings and in FIG. 5 upper and lower portions 26 and 27 respectively of a slag retaining device having a modified global shape with flat upper and lower ends 28 and 29 respectively is provided with circumferentially spaced substantially vertically positioned arcuate ribs 30 and grooves 31, the ribs 30 and grooves 31 being alternately arranged. The modified slag retaining device of FIG. 5 may be used as illustrated, like that of FIG. 4, by being positioned in the vortex of the metal flowing out of the tap hole in a converer or ladle where it will move in a bobbing and/or rotating motion as the level of the metal nears the tap hole so that it will seat in the tap hole and allow some metal to flow therethrough creating a substantially increased swirling vortex in the metal and slag which will visually indicate to an operator the proximity of the slag layer to the tap hole and enable the operator to move the converter or close the tap hole in a ladle to prevent the slag from entering the same. The modified forms of the invention are formed of the same material hereinbefore described and of the same or comparable densities to control their desired floating relation with respect to the metal and the slag thereon being controlled with respect to preventing the entry of the slag into the tap hole.

One of the problems heretofore existing in tapping converters, hot metal ladles, and the like, is the irregular shape of the tap hole through which the hot metal flows. The refractory shape normally forming the tap hole in the prior art has been formed by placing a thin metal tube in the tap hole, the tube being of a slightly smaller diameter than the tap hole in the vessel and subsequently forming refractory clay in a putty-like consistency around the tube in the well which surrounds the tap hole as a result of the building up of the refractory lining in the vessel from refractory bricks and the like.

In the present disclosure, the tap hole in the refractory lining in the vessel is formed by a preshaped, prefired, cylindrical sleeve resembling a sewer tile which is positioned in the vessel in registry with the tap hole therein and the refractory lining of the vessel formed directly thereabout. The preshaped, prefired, refractory sleeve is considerably more efficient in resisting erosion of hot metal flowing therethrough than the above described structures of the prior art and they are particularly useful in maintaining a circular configuration in which the slag retaining devices of the present invention may be seated manually or mechanically or floated thereinto all as hereinbefore described.

In FIG. 6 of the drawings the refractory sleeve is illustrated by the numeral 17 and the insulating refractory liner 18 which is usually refractory prefired bricks is shown directly abutting the refractory sleeve 17. Some refractory cement may be used in sealing the refractory bricks to one another and to the refractory sleeve 17 as will occur to those skilled in the art.

Figure 7:
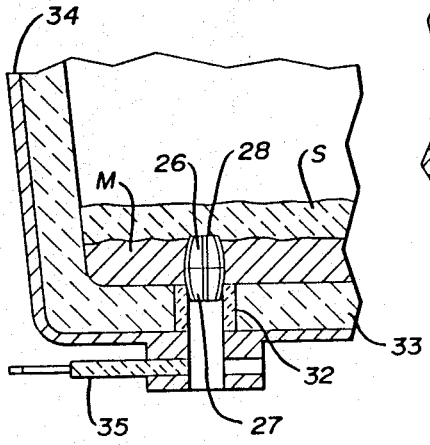
FIG. 7 is a cross sectional view of a portion of a ladle showing the tap hole therein and a cylindrical sleeve therein defining said tap hole with molten steel above the tap hole and molten slag thereon and the slag retaining device of FIG. 4 engaged in the tap hole.

In FIG. 7 of the drawings, the refractory sleeve is indicated by the reference numeral 32 and the insulating refractory lining 33 of the ladle 34 is usually formed of prefired refractory bricks which are laid up in abuttment with the refractory sleeve 32. In FIG. 7 of the drawings, the ladle 34 has a slide valve 35 positioned below the refractory sleeve 32 which can be used to control the flow of hot metal from the ladle as for example when the hot metal is being transferred into a tundish or like receptacle in communication with a continuous caster.

It will thus be seen that the substantially improved slag retaining device as illustrated and described herein in combination with the refractory sleeve defining the tap hole, substantially improves the function of the slag retaining device and in effect automatically shuts off the flow of molten steel through the tap hole before the slag layer reaches the same thus assuring that only clean steel free of slag (non-metallic inclusions) is delivered from the vessel.

Although but four embodiments of the present invention have been illustrated and described, it will occur to those skilled in the art that various changes and modifications may be made therein without departing from the spirit of the invention and having thus described my invention what I claim is:

The embodiments of the invention in which an exclusive property or privilege is claimed are defined as follows:

1. The combination in a vessel for molten metal having a tap hole of a preformed cylindrical refractory sleeve registering with said tap hole and a preformed slag retaining device for selectively engaging said cylindrical refractory sleeve during the drawing off of metal from said vessel, said slag retaining device comprising a closure of a barrel shape having ends and curved sides with a dimension between said ends that is equal to or greater than a maximum dimension between said curved sides and having a size to effectively close said cylindrical refractory sleeve when engaged therein, said slag retaining device and said cylindrical refractory sleeve being formed of refractory materials resistant to dissolution in the molten metal and slag for a time sufficient to assure the lodgement of said slag retaining device in said cylindrical refractory sleeve and wherein said slag retaining device has a density of about 0.12 to about 0.22 lbs. per cubic inch so that it will float in said molten metal and below said slag.

2. The combination set forth in claim 1 and wherein at least one annular groove is formed in the outer surface of said slag retaining device.

3. The combination set forth in claim 1 and wherein a plurality of ribs of modified arcuate shape are formed substantially vertically on the outer surface of said slag retaining device and spaced circumferentially with respect to one another.

4. The combination set forth in claim 1 and wherein a plurality of grooves are formed in the outer surface of said slag retaining device substantially vertically thereof and circumferentially spaced with respect to one another.

5. The combination set forth in claim 1 and wherein a plurality of alternately spaced, substantially vertically positioned ribs and grooves are formed on and in the outer surface of said slag retaining device in circumferentially spaced arrangement with respect to one another.

6. A slag retaining device for a molten metal vessel, said slag retaining device comprising a preformed barrel shaped body having a height as measured between the ends of the barrel shaped body greater than its maximum width as measured between the sides of the barrel shaped body and of a width greater than a tap hole in said vessel, said device being formed of refractory materials resistant to dissolution in said molten metal for a time sufficient to assure the lodgement of said device in said tap hole.

7. A preformed slag retaining device for selectively engaging a tap hole in a vessel for molten metal during the drawing off of metal from said vessel, said slag retaining device comprising a barrel-shaped closure which has ends and curved sides, with the distance between the ends of said barrel-shaped closure being greater than or equal to the maximum distance between said barrel-shaped closure curved sides, said closure being of a size to effectively close said tap hole when engaged therein, said slag retaining device being formed of refractory material resistant to dissolution in the molten metal and slag for a time sufficient to assure the lodgement of said slag retaining device in said tap hole.

8. A preformed slag retaining device for selectively engaging a tap hole in a vessel for molten metal during the drawing off of metal from said vessel, said slag retaining device comprising a barrel-shaped closure said barrel-shaped closure having ends and curved sides, with the curved sides having a portion thereof with a maximum cross section as measured between said curved sides which is slightly larger than the maximum cross section of the tap hole said curved sides having a portion thereof having a cross section as measured between said curved sides which is less than the maximum cross section of the tap hole so the device can be lodged into the tap hole, said barrel-shaped closure having a distance between the ends thereof that is equal to or greater than the maximum distance between the curved sides of the barrel-shaped closure device, an elongated rod positioned axially of said barrel-shaped closure, a portion of said rod extending from one end of said barrel-shaped closure, refractory sleeves positioned on said rod, said rod and refractory sleeves forming guide means engageable in said tap hole for guiding said barrel-shaped closure to engagement in said tap hole, said rod also extending from another end of said barrel-shaped closure whereby said slag retaining device can be introduced into said vessel and moved into alignment for engagement with said tap hole.

* * * * *